US007997219B2

(12) United States Patent
Jackson

(10) Patent No.: US 7,997,219 B2
(45) Date of Patent: Aug. 16, 2011

(54) SYSTEM AND METHOD FOR FACILITATING REMOVAL OF GAUGE PARTS FROM HOOK BAR MODULES

(75) Inventor: James H. Jackson, Chickamauga, GA (US)

(73) Assignee: Card-Monroe Corp., Hixson, TN (US)

( * ) Notice: Subject to any disclaimer, the term of this patent is extended or adjusted under 35 U.S.C. 154(b) by 414 days.

(21) Appl. No.: 12/194,590

(22) Filed: Aug. 20, 2008

(65) Prior Publication Data

US 2009/0050036 A1 Feb. 26, 2009

Related U.S. Application Data

(60) Provisional application No. 60/956,819, filed on Aug. 20, 2007, provisional application No. 60/981,223, filed on Oct. 19, 2007.

(51) Int. Cl.
*D05C 15/22* (2006.01)
*D05C 15/00* (2006.01)

(52) U.S. Cl. ..... 112/80.5

(58) Field of Classification Search ..... 112/80.45–80.6, 112/226

See application file for complete search history.

(56) References Cited

U.S. PATENT DOCUMENTS

| | | | | |
|---|---|---|---|---|
| 1,896,047 | A * | 1/1933 | Grieb | 112/226 |
| 2,213,552 | A | 9/1940 | Scharr | |
| 2,562,939 | A | 7/1951 | Noe | |
| 2,706,459 | A * | 4/1955 | Ayres | 112/226 |
| 2,750,772 | A | 6/1956 | Bellini | |
| 2,800,096 | A | 7/1957 | Signoret | |
| 2,879,728 | A | 3/1959 | McCutchen | |
| 2,889,791 | A | 6/1959 | Fedevich | |
| 3,103,903 | A | 9/1963 | Broadrick et al. | |
| 3,202,379 | A | 8/1965 | Dedmon et al. | |
| 3,375,797 | A | 4/1968 | Gaines | |
| 3,386,398 | A * | 6/1968 | Cobble, Sr. et al. | 112/80.6 |
| 3,460,411 | A * | 8/1969 | Dyer | 81/3.07 |
| 3,485,195 | A | 12/1969 | Torrence | |
| 3,489,326 | A | 1/1970 | Singleton | |
| 3,618,542 | A | 11/1971 | Zocher | |
| 3,709,173 | A | 1/1973 | Greene | |
| 3,757,709 | A | 9/1973 | Cobble | |
| 3,835,797 | A | 9/1974 | Franks et al. | |
| 3,847,098 | A | 11/1974 | Hammel, Jr. | |
| 3,919,953 | A | 11/1975 | Card et al. | |
| 3,926,132 | A | 12/1975 | Lear et al. | |
| 4,111,646 | A | 9/1978 | Buckwalter et al. | |
| 4,134,348 | A | 1/1979 | Scott | |

(Continued)

FOREIGN PATENT DOCUMENTS

DE 2004726 A1 8/1971

(Continued)

*Primary Examiner* — Ismael Izaguirre

(74) *Attorney, Agent, or Firm* — Womble Carlyle Sandridge and Rice PLLC

(57) ABSTRACT

A replaceable gauging element assembly includes a series of gauge modules mounted in spaced series along a gauge bar. The gauge modules each include an upper section having a front face, an intermediate section and a lower section. A series of slots are formed in the front face of the gauge modules for receiving a series of gauge parts therein, with the gauge parts releasably secured within the modules by one or more fasteners. Access openings are formed in the modules for facilitating removal of broken gauge parts from the slots.

14 Claims, 8 Drawing Sheets

U.S. PATENT DOCUMENTS 4,138,956 A 2/1979 Parsons
4,154,176 A * 5/1979 Spanel et al. ..... 112/80.45
4,170,949 A 10/1979 Lund
4,175,497 A 11/1979 Lund
4,193,360 A 3/1980 Lund
4,195,580 A 4/1980 Hurst
4,217,837 A 8/1980 Beasley et al.
4,289,082 A 9/1981 Stoker et al.
4,303,024 A 12/1981 Bardsley
4,313,388 A 2/1982 Biggs et al.
4,354,441 A 10/1982 Hurst
4,366,761 A 1/1983 Card
4,440,102 A 4/1984 Card et al.
4,448,137 A 5/1984 Curtis et al.
4,483,261 A * 11/1984 Green et al. ..... 112/80.45
4,487,140 A 12/1984 Inman
4,491,078 A 1/1985 Ingram
4,509,439 A 4/1985 Densmore et al.
4,528,921 A 7/1985 Slattery
4,562,781 A 1/1986 Green
4,574,716 A 3/1986 Czelusniak, Jr.
4,608,934 A * 9/1986 Card et al. ..... 112/80.6
4,619,212 A 10/1986 Card et al.
4,630,558 A 12/1986 Card et al.
4,637,329 A 1/1987 Czelusniak, Jr.
4,667,611 A 5/1987 Yamamoto et al.
4,669,171 A 6/1987 Card et al.
4,691,646 A 9/1987 Card et al.
4,693,191 A 9/1987 Card et al.
4,739,717 A 4/1988 Bardsley
4,808,354 A 2/1989 Nickols
4,815,403 A 3/1989 Card et al.
4,817,541 A 4/1989 Magourik
4,822,241 A 4/1989 Jarvis et al.
4,836,118 A 6/1989 Card et al.
4,841,886 A 6/1989 Watkins
4,856,441 A 8/1989 Kurata
4,864,946 A 9/1989 Watkins
4,903,624 A 2/1990 Card et al.
4,903,625 A 2/1990 Card et al.
4,989,528 A * 2/1991 Fujita ..... 112/226
5,058,518 A 10/1991 Card et al.
5,094,178 A 3/1992 Watkins
5,148,759 A * 9/1992 Wirth ..... 112/470.26
5,182,997 A 2/1993 Bardsley
5,189,966 A 3/1993 Satterfield
5,224,434 A 7/1993 Card et al.
5,295,450 A 3/1994 Neely
5,400,727 A 3/1995 Neely
5,509,364 A 4/1996 Bardsley
5,513,586 A 5/1996 Neely et al.
5,544,605 A 8/1996 Frost
5,575,228 A 11/1996 Padgett, III et al.
5,622,126 A 4/1997 Card et al.
5,743,201 A 4/1998 Card et al.
5,896,821 A 4/1999 Neely et al.
5,899,152 A 5/1999 Bardsley et al.
5,954,003 A * 9/1999 Beyer et al. ..... 112/80.45
5,983,815 A 11/1999 Card
6,009,818 A 1/2000 Card et al.
6,105,522 A 8/2000 Kato
6,116,173 A 9/2000 Beyer
6,155,187 A 12/2000 Bennett et al.
RE37,108 E 3/2001 Neely
6,213,036 B1 4/2001 Slattery
6,244,203 B1 6/2001 Morgante et al.
6,260,493 B1 7/2001 Dean
6,263,811 B1 7/2001 Crossley
6,283,053 B1 9/2001 Morgante et al.
6,409,030 B1 6/2002 Schlemper
6,439,141 B2 8/2002 Morgante et al.
6,446,566 B1 9/2002 Bennett et al.
6,502,521 B2 1/2003 Morgante et al.
6,508,185 B1 1/2003 Morgante et al.
6,516,734 B1 2/2003 Morgante et al.
6,550,407 B1 4/2003 Frost et al.
6,672,230 B2 1/2004 Green et al.
6,675,729 B2 1/2004 Green
6,758,154 B2 7/2004 Johnston
6,807,917 B1 10/2004 Christman et al.
6,834,601 B2 12/2004 Card et al.
6,986,317 B2 * 1/2006 Biehl, Sr. ..... 112/475.01
7,007,617 B2 3/2006 Johnston
7,107,918 B2 9/2006 Caylor et al.
7,191,717 B2 3/2007 Green et al.
7,214,901 B1 5/2007 Ball et al.
7,237,497 B2 7/2007 Johnston
7,284,492 B2 10/2007 Johnston
7,398,739 B2 7/2008 Johnston
7,597,057 B2 10/2009 Johnston et al.
2004/0187268 A1 9/2004 Johnston
2005/0150876 A1 7/2005 Green et al.
2006/0150882 A1 7/2006 Johnston
2006/0225630 A1 10/2006 Kilgore
2008/0264315 A1 10/2008 Neely

FOREIGN PATENT DOCUMENTS

DE 2503563 A1 8/1976
DE 2828278 A1 1/1979
DE 29520281 3/1996
EP 1645 659 A1 4/2006
GB 1335906 A 10/1973
GB 1418123 A 12/1975
GB 1 507 166 A 4/1978
GB 2 002 040 A 2/1979
GB 1541074 A 2/1979
GB 1597733 A 9/1981
GB 2076441A A 12/1981
GB 2104925A A 3/1983
GB 2 266 537 A 11/1993
GB 2295161 A 5/1996
MG 1594626 A 8/1981
WO WO-9006391 A1 6/1990
WO WO-01/20069 A1 3/2001
WO WO-03/056091 A1 7/2003
WO WO-2005/054561 A1 6/2005
WO WO-2006/076558 7/2006
WO WO-2006/076558 A1 7/2006
WO WO-2008/134293 11/2008
WO WO-2009/023512 2/2009

* cited by examiner

SYSTEM AND METHOD FOR FACILITATING REMOVAL OF GAUGE PARTS FROM HOOK BAR MODULES

CROSS REFERENCE TO RELATED APPLICATIONS

This application claims the benefit of U.S. Provisional Application No. 60/956,819, entitled GAUGING ELEMENT MODULES, filed Aug. 20, 2007, and U.S. Provisional Application No. 60/981,223, entitled GAUGING ELEMENT MODULES, filed Oct. 19, 2007, each of the listed applications being incorporated herein by reference in their entireties.

FIELD OF THE INVENTION

The present invention generally relates to the design and assembly of gauging elements or parts for tufting machines, and in particular to a gauging element assembly for tufting machines that facilitates the efficient removal and replacement of broken or damaged gauging elements or parts therefrom.

BACKGROUND OF THE INVENTION

During the operation of tufting machines, a series of needles mounted along a reciprocating needle bar and carrying a series of yarns penetrate a backing material and are each engaged by corresponding hooks or loopers for forming cut and/or loop pile tufts of yarns in the backing material. Such engagement between the needles and hooks or loopers requires close precision in the positioning and operation of the needles and the hooks or loopers to ensure efficient and accurate operation of the tufting machine. During assembly of the tufting machines, it therefore is important that the needles, loopers, hooks, and/or other gauge parts be accurately mounted along their respective needle and/or hook or looper bars to ensure that such gauge elements or parts are accurately and consistently spaced and positioned along their needle and hook or looper bars. If the gauge parts are misaligned, the individual gauge elements can become broken or damaged, and tufts of yarns can be mis-sewn, resulting in inaccurate or irregular patterns being formed, which carpets generally have to be discarded.

Accordingly, it has been common practice to assemble and cast gauge parts such as needles, loopers, or hooks in modules, typically including five to ten, or more, individual gauge elements in precisely spaced series. These modules then can be mounted on a gauge bar to help ensure substantially consistent and accurate spacing of the gauge parts. One problem that arises, however, is that typically with such cast modules, especially where such modules are used in smaller gauge (i.e., 10 gauge or less) tufting machines, if a single gauge part such as a hook, looper or needle fails, (i.e., by becoming broken or dull), the whole module must be replaced. Such replacement of the modules is expensive and often can result in the additional removal and replacement of several undamaged or fully functional hooks or loopers within each of the modules, which leads to potential waste of other hooks/loopers in the module that are still operable. Additionally, even where the modules are made with replaceable gauge parts, such parts often can break off inside the module, making their replacement difficult and sometimes can still require replacement of the entire module Accordingly, it can be seen that a need exists for a replaceable gauging element module that addresses the foregoing and other related and unrelated problems in the art.

SUMMARY OF THE INVENTION

Briefly described, the present invention generally relates to a replaceable gauging element assembly and/or gauge module for use in tufting machines and similar systems. The replaceable gauging element assembly for the present invention generally will include a series of gauge modules each having a module body in which gauge part such as a cut pile hook, loop pile looper, level cut loop looper or other, similar gauge part as received. The module bodies will be mounted in series along a gauge bar that typically will be connected to a drive mechanism for the tufting machine so as to reciprocate the modules, and thus the gauge parts therein, toward and away from a tufting zone of the tufting machine and into and out of engagement with the needles of the tufting machine so as to form loops or tufts of yarns in a backing material passing through the tufting zone of the tufting machine.

Each module body generally will be cast or otherwise formed from a rigid, durable material such as steel, aluminum, various alloy or other metal materials, or can include synthetic or composite materials having sufficient durability in strength. Each module body generally will include an upper section having a top surface, a forwardly projecting portion defining a front face, and a rearwardly projected portion defining a rear face. A series of spaced slots typically will be formed across the front face of the upper section of each module body, extending at least partially through the module body toward the rear face thereof. The gauge parts will be releasably received within the slots of the module body, which align and separate the gauge parts in spaced series according to the gauge of the tufting machine, for engagement with corresponding needles of the tufting machine.

Each module body further generally will include an intermediate portion or section with a lower section or end extending therefrom. At least one fastener opening typically will be formed through the intermediate or lower sections for securing the module body to the gauge bar. One or more fasteners, such as set screws or other removable fasteners can be received through this fastener opening, projecting inwardly toward the slots for securing the gauge parts therein. Additionally, a locking member can be received and extended through the module body so as to engage a bottom portion of each of the engaged parts received within the slots, with the locking member being urged into a tight, engaging position against the bottom portions of the gauge parts by the insertion of one or more fasteners therein. Additionally, one or more locating features, such as tabs, pins, notches, etc. can be formed along the rear sides of the modules, generally along the rearwardly facing sides of the lower and intermediate sections thereof. The locating features will be adapted to engage corresponding locating features along the gauge bar to help position the modules in a desired alignment therealong.

Additionally, a series of access openings are formed through each of the module bodies, extending into communication with the slots formed through the upper sections of the module bodies. Each of the access openings can be aligned with one or more of the slots, and generally will be formed along a corner portion, which can include a beveled edge adjacent the rear face of the rearwardly extending portion of the upper section of each module body. In one embodiment, the beveled edge can be formed in the corner along a rearwardly facing side of the module body between the upper section and intermediate section thereof, with the access openings being formed in spaced series therealong and extending upwardly and inwardly toward the slots. A corresponding beveled edge also can be formed along the gauge bar so that the beveled edge of the gauge bar engages the beveled edge of the module bodies in a mating engagement to help seat the module bodies thereon. Corresponding access passages can be formed through the gauge bar, extending from a rear side through the gauge bars to the beveled edge portion thereof, and being substantially matched and/or aligned with the access openings of each of the module bodies when the module bodies are mounted on the gauge bar. In an alternative embodiment, the beveled edge of the module bodies can be formed between the upper or top surface and the rear face of the upper section, with the access openings being spaced therealong and extending downwardly and inwardly toward the slots in which gauge parts are received.

In use, if a gauge part within a module body becomes broken or otherwise needs replacement, the fastener and/or locking member holding the gauge parts in their respective slots can be removed or released from engagement therewith. A tool can be inserted into the access openings of the module body, and/or through the passages of the gauge bar aligned therewith, so as to urge or force the broken part of the gauge part out of its slot to enable quick and easy removal thereof. Additionally, a cleaning media such as a blast of pressurized air can be applied to the slots through the access openings for cleaning out any dust and debris collected therein to ensure easy replacement of the gauge part with a new gauge part, without having to remove the module from the gauge bar and without replacing entire module.

In still a further embodiment, the gauge bar can be formed with a chamfer or beveled edge along a rear portion thereof, and can be provided with a series of spaced access openings or passages extending therethrough toward a front face of the gauge bar. One or more gauge modules or module blocks can be mounted side by side in series along the length of the gauge bar and can receive a series of gauge parts therein. The gauge parts can include cut pile hooks, loop pile loopers, level cut loop loopers, or a variety of other gauge parts and generally will be releasably secured therein by one or more fasteners that engage and secure a shank or body portion of each of the gauge parts within their gauge modules. The gauge modules further can be provided with slots or access openings along a rear portion thereof, which slots or access openings can be generally aligned with the access passages or openings formed through the gauge bar. In the event that a gauge part within a module body becomes broken or otherwise needs replacement, the gauge part can be released from a locked engagement within the module body and a tool or stylus can be inserted through the corresponding passage of the gauge bar and through the appropriate slot or opening formed in the gauging module corresponding to the location of the broken gauge part so as to urge the piece of the broken gauge part out of the module body. The broken gauge part can thereafter be quickly and easily replaced, and a cleaning media such as pressurized air also can be directed through the slot of the module body and/or the passage of the gauge bar and module body to clean dust, debris, etc. as needed.

Various features, objects and advantages of the present invention will become apparent to those skilled in the art upon reading the following detailed description, when taken in conjunction with accompanying drawings.

DISCUSSION OF THE INVENTION

Figure 1:
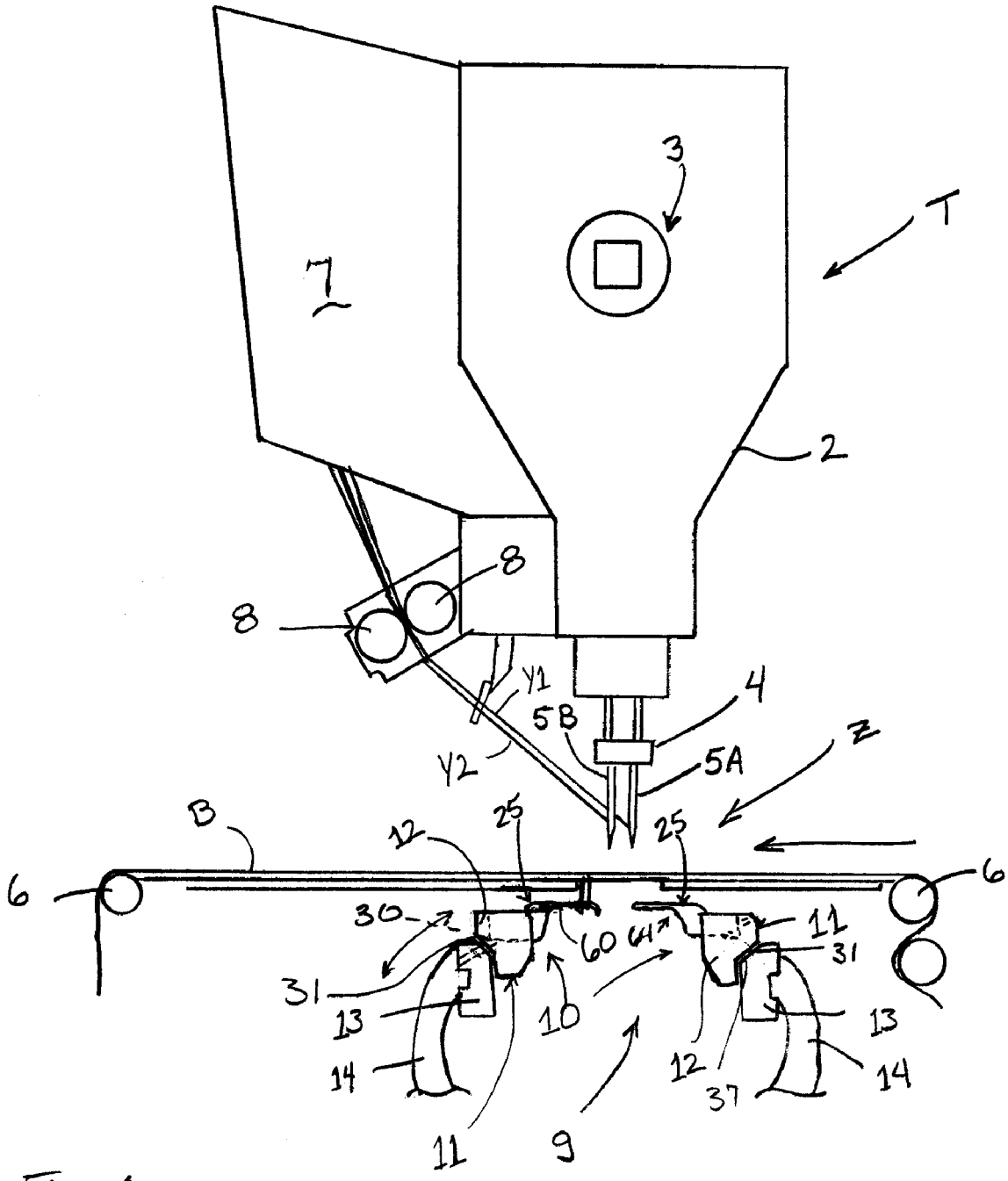
FIG. 1 is a side elevational view generally illustrating a tufting machine with a replaceable gauging element assembly according to the principles of the present invention.

The present invention generally relates to a replaceable gauging element/part assembly 10 or module 11 such as for use in a tufting machine T or other, similar type of operating equipment with replaceable assemblies. As indicated in FIG. 1, the tufting machine T generally will comprise a tufting machine such as disclosed in U.S. Pat. Nos. 5,979,344, 7,096,806 and/or 7,359,761, the disclosures of which are incorporated by reference as if fully set forth herein. The tufting machine generally will include a frame 2 on which is supported a machine drive, including a main drive shaft 3 that reciprocally drives one or more reciprocating needle bars 4 carrying spaced needles 5A, 5B mounted in space series therealong the needle bar(s) and defining a tufting zone Z through which a backing material B is fed by backing rolls 6. A series of yarns, indicated by Y1 and Y2, are fed from a yarn feed mechanism 7 through puller rolls 8 to each of the needles 5A and 5B. The yarn feed mechanism 7 can include a variety of different types of yarn feed mechanisms, including scroll, roll, single end and double end type pattern yarn feed attachments, such as an Infinity™ or Infinity IIE™ attachment as manufactured by Card-Monroe Corp. The yarn feed mechanism controls the feeding of the yarns Y1 and Y2 to the needles, which penetrate the backing B and are engaged by hook or looper assembly 9 of the tufting machine, mounted below the tufting zone Z, in order to form tufts of yarns within the backing material as indicated in FIG. 1.

In one embodiment of the replaceable gauging element assembly 10 of the present invention shown in FIGS. 1-4, the replaceable gauging element assembly 10 generally will include a series of gauging element modules 11 each having a body 12 that can be mounted in a predetermined orientation or location beneath the tufting zone Z of the tufting machine, along a gauge bar 13 as indicated in FIG. 1. Each module body 12 can be cast, machined, or molded from various metal or metal alloy materials such as aluminum, steel, etc., or from various plastic or synthetic materials, composites, or other, similar high strength materials, and can be formed in various configurations and/or sizes. Similarly, the gauge bar 13 can be formed from a high strength material, typically a metal such as steel, and will be mounted to a drive mechanism 14 (i.e., a looper or hook drive) for the hook or looper assembly 9 of the tufting machine.

Figure 2:
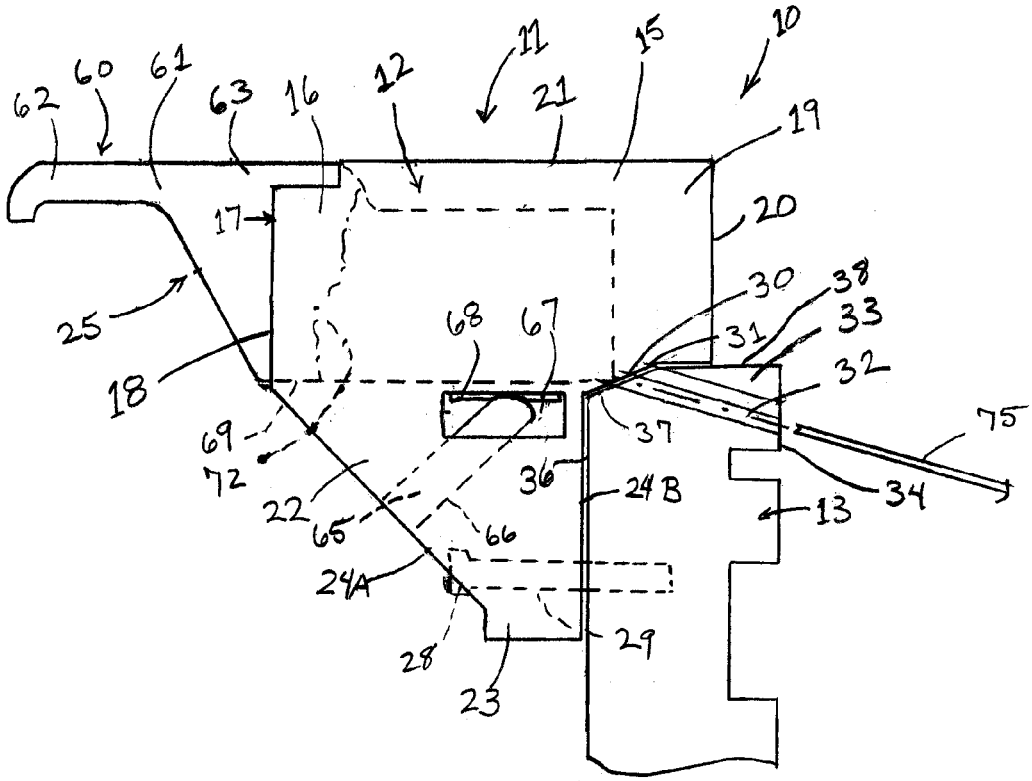
FIG. 2 is a side elevational view generally illustrating one embodiment of the replaceable gauging element.
Figure 3:
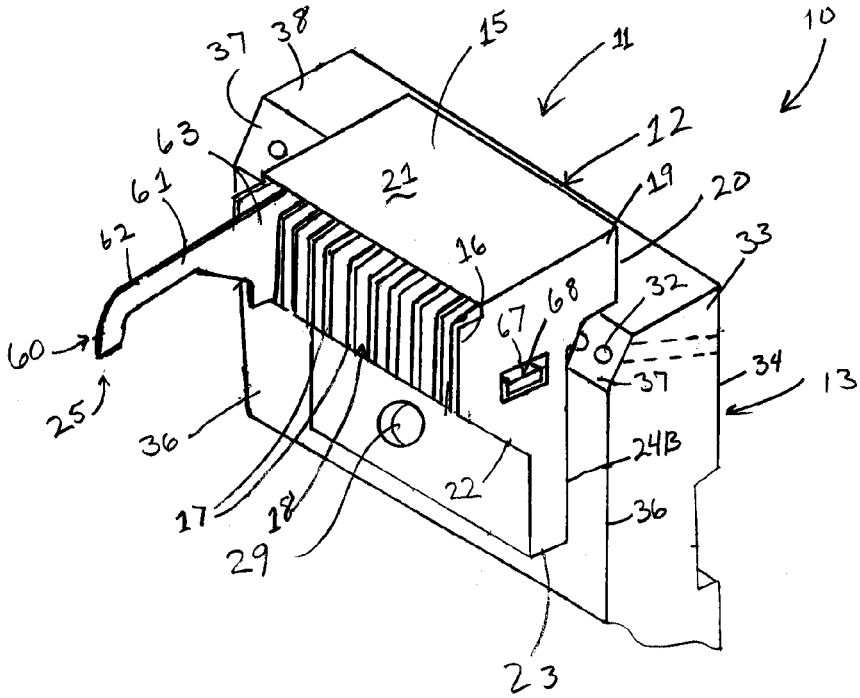
FIG. 3 is a side elevational view illustrating a gauging element module of the replaceable gauging element assembly of FIG. 2 mounted to a gauge bar.
Figure 4:
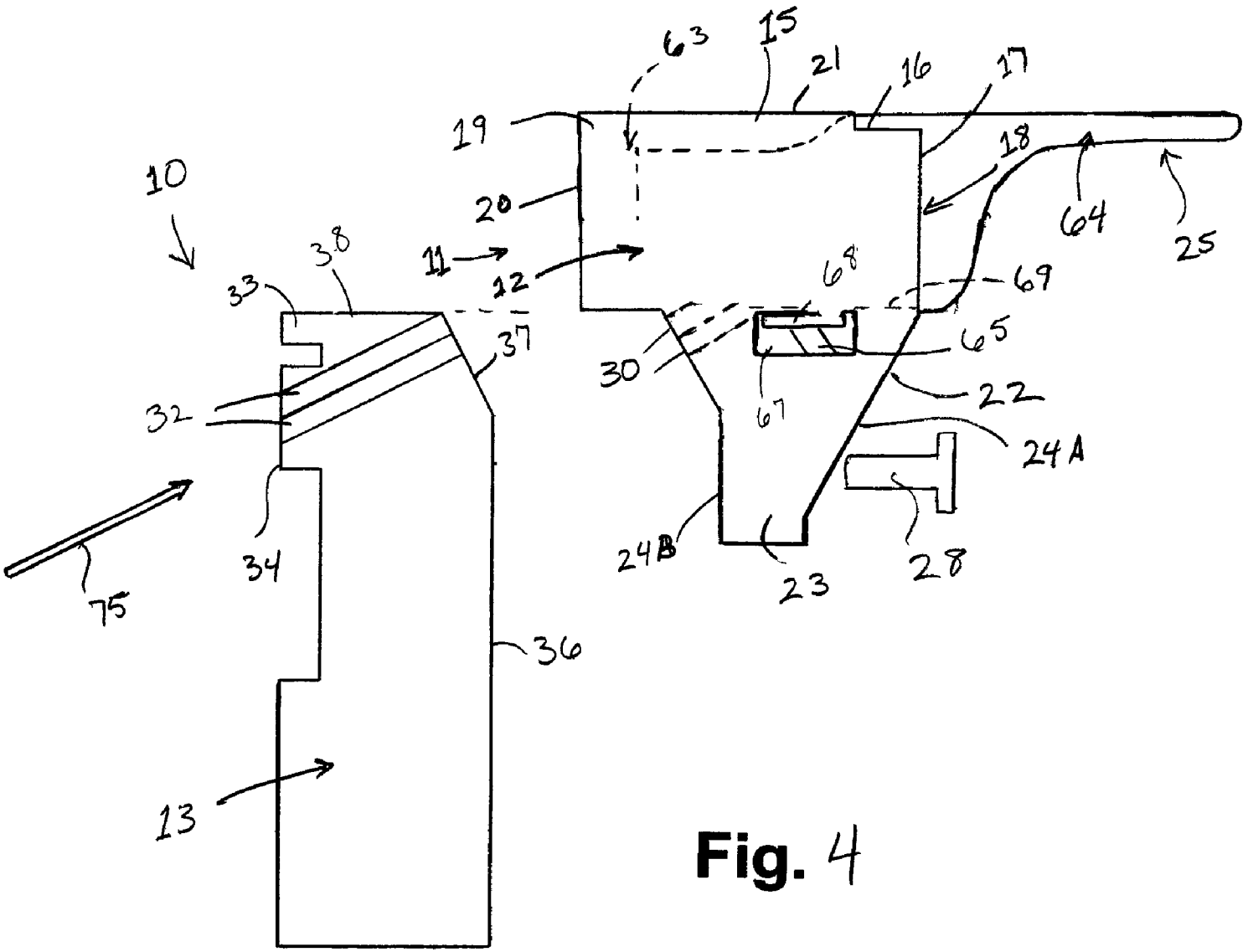
FIG. 4 is a perspective view of the replaceable gauging element module of FIGS. 2-3 attached to a gauge bar.

As shown in FIGS. 2-4, each module body 12 generally will include an upper portion or section 15 having a front or forwardly facing portion 16 defining a front face 17 having a series of spaced slots 18 (FIG. 3) formed therein, a rearwardly projecting portion 19 defining a rear face 20 and a top surface 21. An intermediate section 22 is formed below the upper section 16, with a lower, vertically extending portion or section 23 projecting downwardly therefrom the intermediate and lower sections further defining front and rear sides 24A-24B (FIGS. 2 and 4). As shown in FIGS. 2-4, a series of gauge parts 25 generally are received within the slots 18 formed in the module body and are retained therein. The module body further can include one or more locating devices, such as indicated at 26 in FIGS. 5-6 for engaging the gauge bar 13 and helping to position and arrange the modules along the gauge bar. The locating devices 26 can include pins, tabs, projections or other similar mechanisms, formed or mounted along the rearwardly facing side 24B of the lower and/or intermediate sections module body and adapted to be received within corresponding locating devices such as slots or recesses 27 formed in the removable gauge bar. Additionally, the modules 11 typically are secured to the gauge bar by removable fasteners 28, such as set screws, bolts, pins, or the like, received through fastener openings 29 as indicated in FIG. 2.

As further shown in FIGS. 1 and 3, one or more access openings or slots 30 generally will be formed in the module body. In one embodiment as shown in FIGS. 1 and 3, the access openings 30 can be located along a beveled corner portion 31 formed between a lower surface of the rearwardly projecting portion 19 and rearwardly facing side 24B of the module body 12. The access openings 30 can be individual openings or holes each aligned with a selected one of the slots 18 formed through the upper section 15 of each module body, or alternatively can include one or more elongated slots extending laterally across the corner portion 31 so as to be in communication with multiple ones of the slots 18 formed in the top portion of each module body.

As additionally indicated in FIGS. 1-3, the gauge bar 13 also generally will include a corresponding series of openings or passages 32 formed therethrough. These passages 32 generally will extend through an upper portion 33 of the gauge bar from a rear side 34 of the gauge bar through the bar to a front face 36 of the gauge bar. The passages also can be spaced along a beveled corner portion 37 of the gauge bar, formed between the upper and front sides or faces 38/36 of the gauge bar 13, and which is designed to mate or seat against the beveled corner portion 31 of each gauging element module mounted along the gauge bar as shown in FIGS. 1-4. The passages 32 of the gauge bar can be oriented at an angle, or can be substantially straight and generally will align with the access openings or passages 30 of gauging element modules mounted therealong, as indicated in FIGS. 2 and 4.

Figure 5:
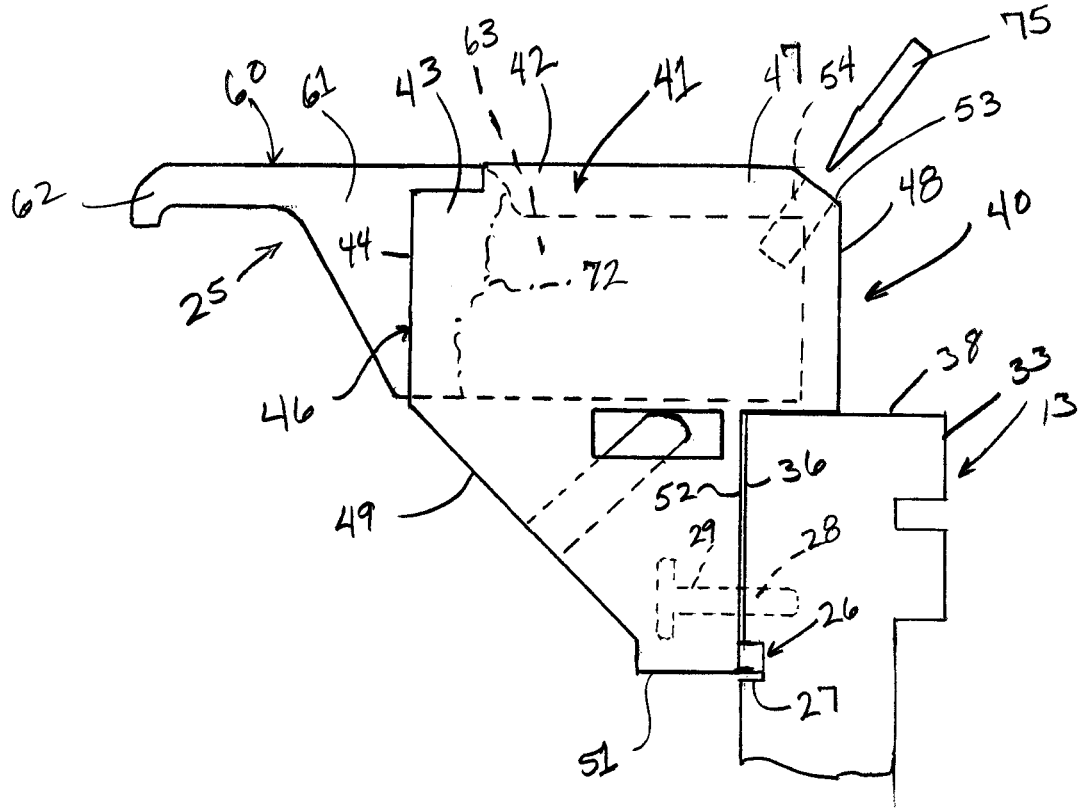
FIG. 5 is a side elevational view of another embodiment of the replaceable gauging element module according to the principles of the present invention.
Figure 6:
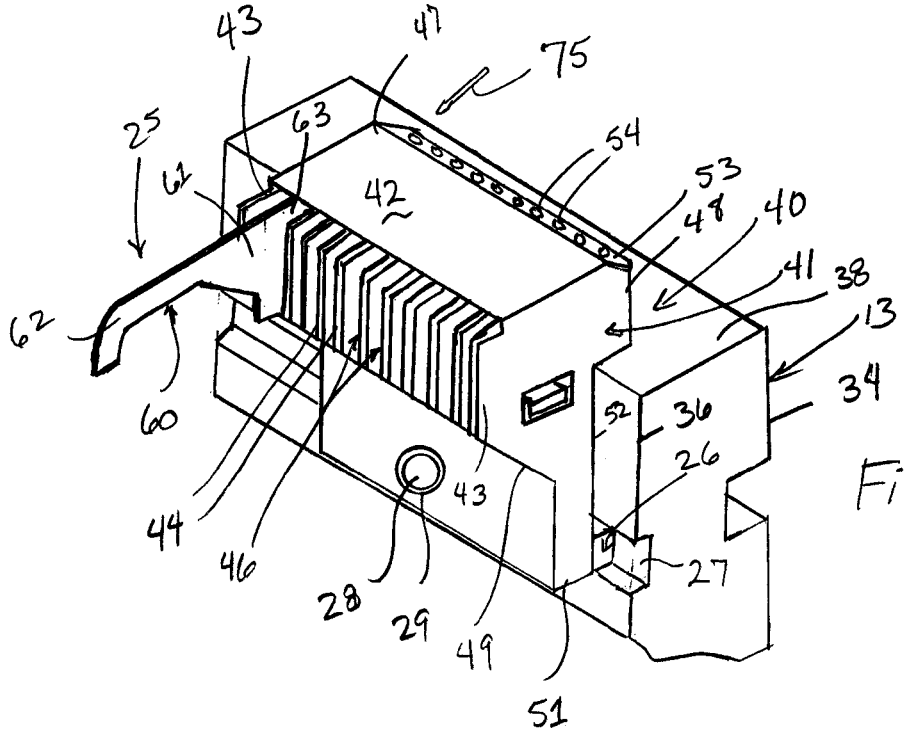
FIG. 6 is a perspective view of the replaceable gauging element module of FIG. 5.

In an alternative embodiment of the replaceable gauging element assembly according to the principles of the present invention, shown in FIGS. 5-6, the modules 40 will include a module body 41 having an upper or top portion 42 with a forwardly projecting portion 43 defining a front face 44 with a series of slots 46 in which the gauge parts 25 are received and a rearwardly projection portion 47 defining a rear face 48, an intermediate section 49 and a lower section 51, with a rear face 52 defined along the intermediate and lower sections 49 and 51. As indicated in FIG. 6, a beveled portion 53 is formed along a corner 54 between the rear face or portion 52 and the top or upper portion 42. A series of access openings or passages 54 are formed at spaced intervals along the beveled portion 53. The access openings 54 provide access to the slots 46 in which the gauge parts 25 are received to facilitate removal of broken gauge parts therefrom.

As shown in the example embodiments illustrated in FIGS. 3, 5 and 6, the gauge parts 25 generally can include cut pile hooks, loop pile loopers, or other types of gauge parts that will be releasably received and mounted within the slots 18 formed in the front upper portion of the module body. Other types of gauge parts such as level cut loop loopers, reeds, etc. . . . also can be used in the replaceable gauging element assembly and modules of the present invention. Typically, there can be approximately 5-10 loopers, hooks, or other gauge parts received and mounted within each module body, although it will also be understood by those skilled in the art that lesser or fewer numbers of hooks, loopers, or other gauge parts also can be used with the replaceable gauging element modules formed according to the principles of the present invention. In operation, such hooks or loopers will engage and pull loops of yarn from the needles of the tufting machine as the needles penetrate a backing material to form loop and cut pile tufts in the backing material.

FIGS. 2 and 3 generally illustrate the use of cut-pile hooks 60 as the gauge parts 25 mounted in the modules. Each cut pile hook generally is formed from a rigid, durable material such as steel, aluminum, or other similar material, and generally includes an elongated body 61 having a hooked or barbed front end or bill portion 62, and a rear, tail or shank portion 63 that is received in one of the slots 18 of the module body 12 and extends substantially through the module body as indicated in FIG. 2. It also will be understood by those skilled in the art that while the present invention is illustrated in FIGS. 2 and 3 in one example embodiment including the use of cut pile hooks, other gauging elements or parts, including loop pile loopers 64 (FIG. 4), needles, level cut loop loopers or hooks, reeds, or other elements also can be releasably mounted within the replaceable gauging element modules formed according to the principles of the present invention.

Each of the loopers, hooks, or other gauge parts generally will be secured within their respective slots of their module body by one or more fasteners 65, indicated by dashed lines in FIGS. 2 and 5, such as one or more set screws, detents, or other, similar removable fasteners 65 that can be received through one or more fastener openings 66 formed along the intermediate section of the front facing portion or side of the module body. Additionally, a channel 67 (FIGS. 2-5) can be formed through the center portion of each module body, extending between the side surfaces thereof, for receiving a locking member, such as a leaf spring, bar, or other similar biasing or locking member 68 (FIGS. 2, 3 and 6) generally formed from metal, plastic, or other resilient material. The locking member can be engaged by one or more of the fasteners 65 so as to force the locking member 68 into engagement with a bottom portion or edge 69 (FIG. 2) of the shank 63 of each of the loopers, hooks, or other gauge parts received within the slots of the module body so as to bear against the loopers, hooks, or other gauge parts and maintain them in their fixed position or orientation within the module body. The fasteners 65 are moved into engagement with the locking member 68 as they are moved along their fastener recesses or openings 66 so as to force or urge at least a portion of the locking member upwardly and into engagement with the bottom surfaces of the one or more loopers, hooks or other gauge parts contained within the module body to secure the loopers, hooks, or other gauge parts therein, as indicated in FIG. 2.

In use, the replaceable gauging element modules 11 (FIG. 1) of the present invention, with the cut pile hooks, loop pile loopers, or other gauging elements or parts 25 received therein, generally will be mounted in spaced series along the gauge bar 13, within a tufting machine T. The replaceable gauging element modules according to the present invention can be used with various types of tufting machines including loop pile, cut pile, level cut loop, cut and loop machines, and/or various other types of tufting machines. In the event that a gauging element or part 25, such as a cut pile hook 60 breaks during use, as indicted by line 72 in FIG. 2, leaving part of the gauging element or part remaining within the module body, with the system of the present invention, the broken gauging element can be quickly and easily replaced.

For changing out a broken or dull gauging element, one or more of the fasteners locking the broken gauging element within the module body will be loosened or removed so as to enable free passage of the broken piece of the gauging element out of the module body. Thereafter, an operator can insert a pin, stylus, or other similar tool 75 through the corresponding passage of the gauge bar and into the access openings or slots 30 (FIG. 2) or 54 (FIG. 5) formed along the beveled rear or corner edge portion 31 (FIGS. 2-4) or 49 (FIGS. 5-6) of each module body (and through the openings or passages 32 of the gauge bar 13 aligned with the access openings 30 as shown in FIG. 4) that are generally aligned with the slot(s) 18 in which the broken gauging element(s) or pieces thereof are contained. The operator then can urge the broken piece of the gauging element out of the slot. Additionally, air or other cleaning fluid media can be injected into the slots through the access openings and passages 32 as needed to further clean out or remove any dust, other debris, or remaining pieces of the gauging element from the slot to ensure that a replacement gauging element can be accurately and easily seated therein. Thereafter, the replacement gauging element will be inserted into the slot and secured in place by reinstallation of the fasteners associated therewith.

Figure 7A:
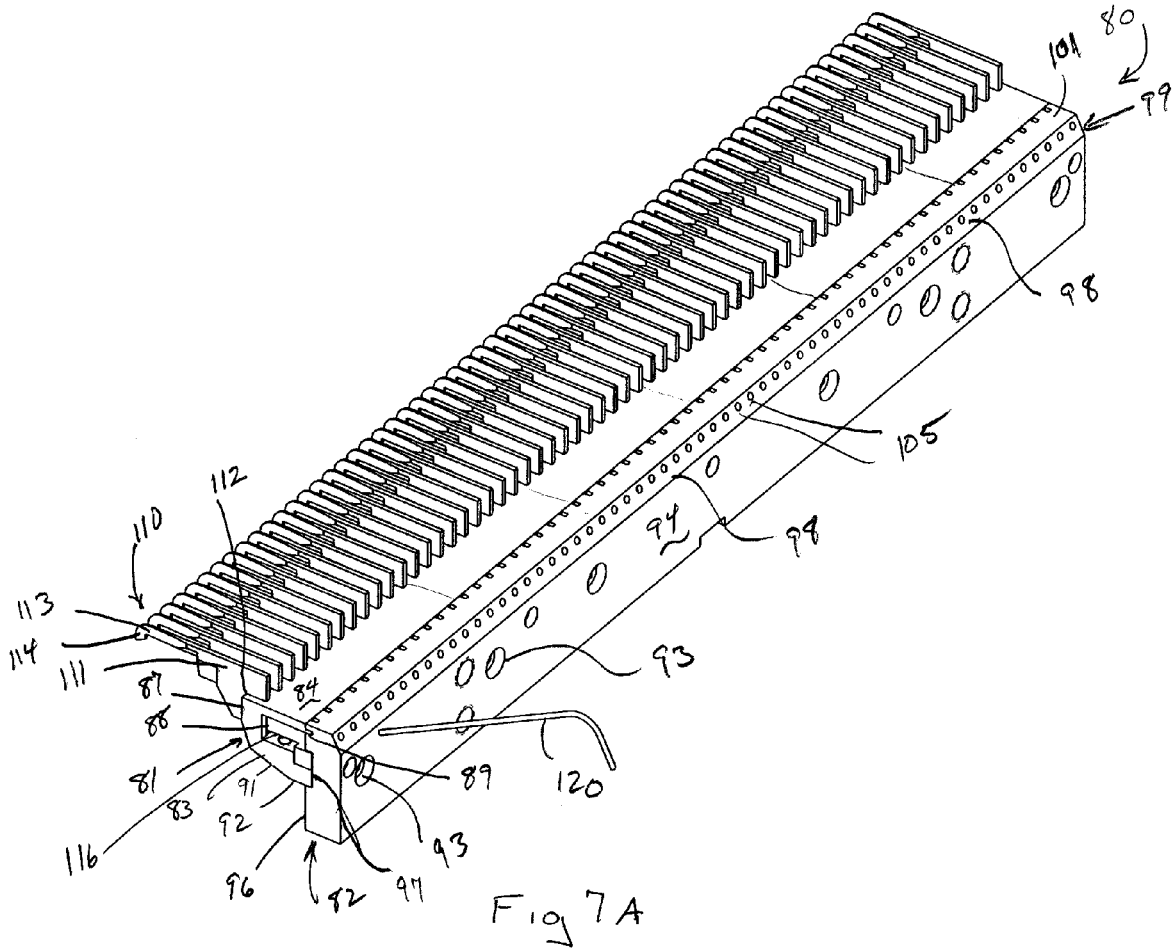
FIGS. 7A-7B are prospective views illustrating yet another embodiment of the replaceable gauging element assembly according to the principles of the present invention.
Figure 7B:
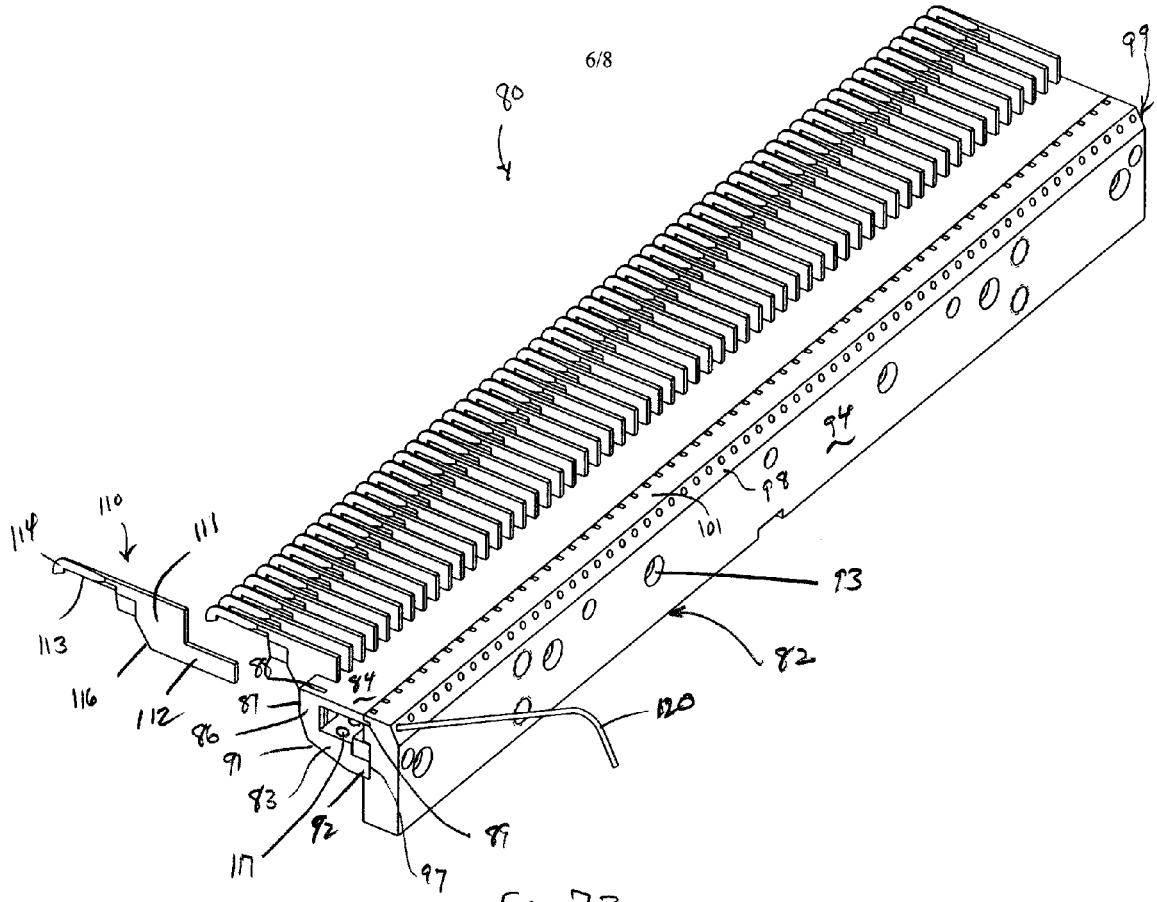
Figure 8A:
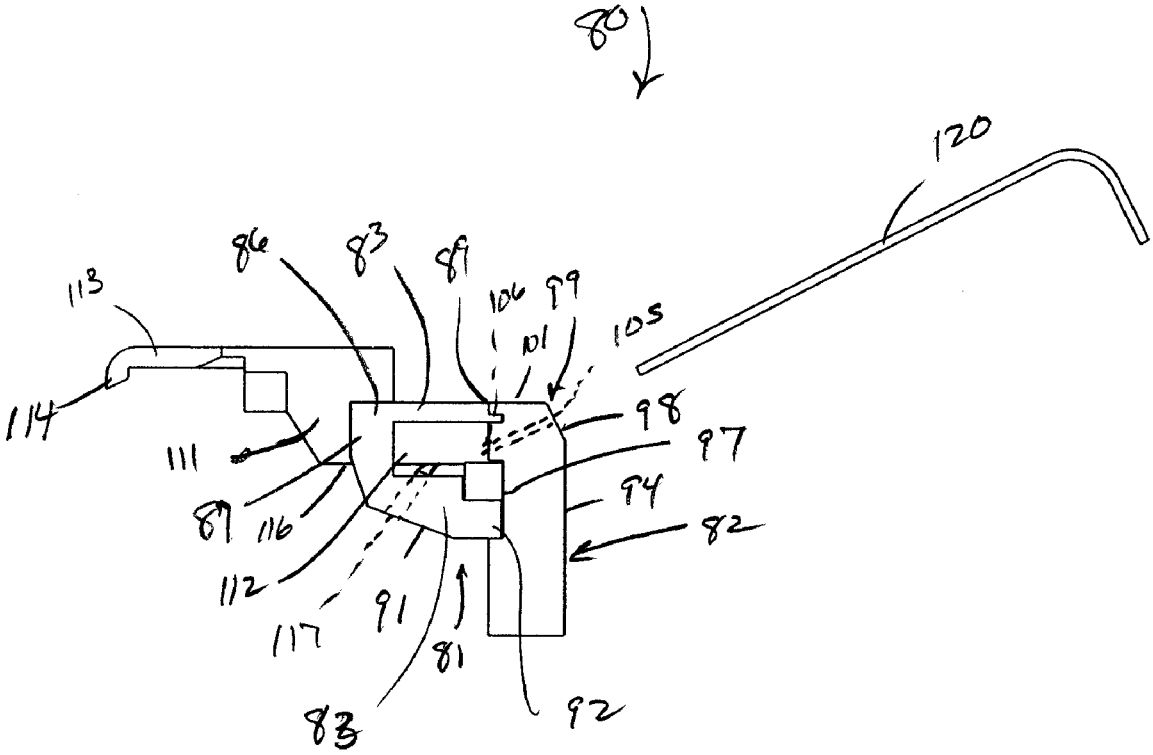
FIGS. 8A and 8B are side elevational views of a gauging element module mounted to the hook bar according to the embodiment illustrated in FIGS. 7A and 7B, illustrating the operation for removal of a broken gauge part from the gauging element module.
Figure 8B:
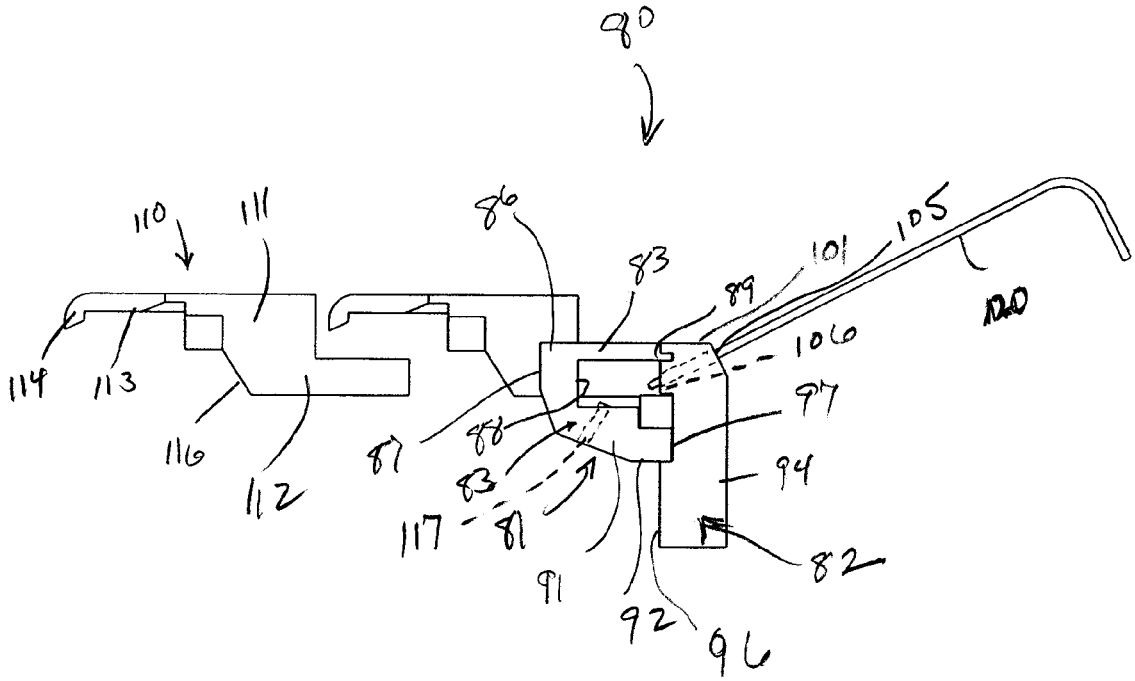

Still a further alternative embodiment of the replaceable gauging element assembly 80 according to the principles of the present invention is shown in FIGS. 7A-8B. In this embodiment, one or more gauging element modules 81 are mounted in a side by side arrangement along a gauge bar 82, here illustrated as a hook bar. Each of the gauging element modules 81 generally will include a module body 83 having an upper or top portion 84, a front or forwardly projecting portion 86 with a substantially flat front face 87 having a series of slots 88 formed therein, and a rear portion 89. The body 83 of the gauging element module 81 further will include a downwardly sloping intermediate section 91 and a the lower portion or section 92 that projects downwardly and rearwardly from the intermediate section 91, as indicated in FIGS. 8A and 8B. A series of fasteners (not shown) typically will be inserted through the intermediate sections of the gauging element modules and will engage corresponding fastener openings 93 (FIG. 7-A) formed in a rear side surface 94 of the gauge bar for securing the module bodies of the gauging element modules 81 to the gauge bar.

As indicated in FIGS. 7A-7B, the gauge bar 82 generally will include rear surface 94, and a front face of surface 96 having a recess or slot 97 formed therealong for receiving the lower portion 92 of the gauging element modules therein to help locate and secure the gauging element modules along the front face 96 of the hook bar 92. The gauge bar further will include a chamfer or beveled portion 98 formed along the corner 99 defined between the rear face 94 of the gauge bar and an upper surface or face 101 of the gauge bar, as indicated in FIGS. 7A and 7B. A series of passages or access openings 105 will be formed in spaced series along the chamfer 98 of the gauge bar 82, with the passages extending downwardly through the body of the gauge bar as indicated by the dashed lines in FIGS. 8A and 8B. The passages 101 generally will be aligned with corresponding access openings and/or passages 106 (FIGS. 8A and 8B) formed in the rear side of the module bodies, with each passage 105 generally corresponding to a particular passage 106 of a module body. The passages 105 and openings 106 of the gauge bar and module bodies further are aligned with the slots 88 (FIGS. 7A and 7B) formed in the module bodies for enabling access to the slots in which the gauge parts 110 are received to facilitate removal and replacement thereof.

As indicated in FIGS. 7A-8B, a series of gauge parts 110 will be received within each of the slots 88 of the module bodies. The gauge parts can include a variety of different types of gauge parts, here shown as including cut pile hooks, although it will be also understood that loop pile loopers, a level cut loop loopers, reeds and other gauge parts, also can be received and releaseably mounted within the slots of the gauging element modules. As indicated in FIGS. 7B-8B, each of the gauge parts typically includes a body 111 of a rearwardly extending shank portion 112, and a forwardly extending broke portion 113 terminating in a bill or hook 114. Each of the gauge parts will be received within one of the slots 88 formed in a gauging element module and will be releasably secured therein by engagement of a lower surface 116 new body portion of each gauging element by a fastener 117 and/or the use of a locking member, as described more fully above. Thus, the gauging elements will be secured for use in a tufting operation, or similar driven operation.

If a gauging element becomes broken or in jammed or otherwise needs to quickly and easily removed from its slot within its gauging module. As indicated in FIGS. 7B and 8B, an operator can remove the fastener securing the gauge part that needs to be removed so as to release it from its fixed engagement within the module block. A stylus such as a rod, punch or similar tool 120 thereafter can be inserted into and through the passage 105 corresponding to the slot 88 in which the gauge part that needs to be replaced resides. As indicated in FIG. 8B, the tool can be inserted all the way through the gauge bar and into the module body, into contact with the rear shank portion of the gauging element, whereupon the gauging element or broken part thereof, can be urged out of its slot in the gauging element module. Thereafter, as needed or desired, a cleaning media, such as pressurized air and/or lubricants can be injected into the slot 88, such as via the passage 105 of the gauge bar, after which the gauging element can be replaced within the gauging module and secured thereto for continued operation of the gauging element assembly.

Such removal and replacement of a broken gauging element piece thus can be accomplished quickly and easily without requiring the replaceable gauging element module to be removed from the gauge bar along which it is attached. The present invention further enables the individual gauging elements to be installed or removed from the gauging element module for use in a tufting machine, without requiring such gauging elements to be permanently molded or fixed within the module body, and allows far easier and more efficient access to and change out of such gauging elements after the modules have been installed within a tufting machine. Accordingly, the tufting machine can be returned to operation quickly and efficiently since the gauging element modules do not need to be removed from the gauge bar and thus the tufting machine for replacement of one or more broken gauging elements therein.

It will be further understood by those skilled in the art that while the present invention has been described above with reference to preferred embodiments, numerous variations, modifications, and additions can be made thereto without departing from the spirit and scope of the present invention as set forth in the following claims.

I claim:

1. A gauging module, comprising:

a module body having a front facing portion, a rear facing portion, an upper portion, a lower portion and a series of slots formed through said module body and each having an opening along said front facing portion;

a series of gauge parts removably received within said module body;

at least one fastener extendable into said module body for releasably securing at least one of said gauge parts within said module body; and a series of access openings formed along at least a portion of said module body, each of said access openings formed at spaced intervals and aligned and in communication with at least one of said slots, and wherein each access opening is aligned with at least two of said slots in said module body;

wherein for removal of one of said gauge parts from said module body, a tool is received through at least one of said access openings to urge said gauge part out of its slot formed within said module body.

2. The gauging module of claim 1 and wherein each access opening is aligned with a selected one of said slots in said module body.

3. A gauging module, comprising:

a module body having a front facing portion, a rear facing portion, an upper portion, a lower portion and a series of slots formed through said module body and each having an opening along said front facing portion;

a series of gauge parts removably received within said module body;

at least one fastener extendable into said module body for releasably securing at least one of said gauge parts within said module body; and a series of access openings formed along at least a portion of said module body, each of said access openings formed at spaced intervals and aligned and in communication with at least one of said slots, and wherein said access openings are formed along a corner defined between said rear facing portion and said lower portion of said module body and defines a beveled edge along which said access openings are formed;

wherein for removal of one of said gauge parts from said module body, a tool is received through at least one of said access openings to urge said gauge part out of its slot formed within said module body.

4. The gauging module of claim 1 and wherein said module body comprises a corner having a beveled edge formed between said upper portion and said rear facing portion of said module body.

5. A tufting machine, comprising:

at least one needle bar having a series of spaced needles mounted therealong and carrying a series of yarns, said needles being reciprocated through a tufting zone of the tufting machine;

backing feed rolls moving a backing material through the tufting machine, wherein the backing material is engaged by said needles for forming tufts of yarns therein;

a series of gauge parts positioned below the backing material and adapted to engage said needles for forming the tufts of yarns in the backing material;

at least one gauge bar supporting and carrying said gauge parts in a reciprocating motion toward and away from engagement with said needles;

a series of gauge modules mounted along said at least one gauge bar and in which said gauge parts are releasably mounted, said gauge modules each comprising:

a module body including an upper section having a top surface, a front portion defining a front face, and a rear portion defining a rear face, and a lower section;

a series of spaced slots formed in said front face and extending rearwardly through said upper section for receiving said gauge parts therein;

a series of access openings defined through said module body between said rear portion and said slots; and at least one fastener releasably securing said gauge parts within said slots;

wherein to replace one of said gauge parts, a tool can be received through one of said access openings corresponding to one of said slots in which said gauge parts to be replaced is received, and can urge said gauge part from the slot without requiring removal of said gauge module from said gauge bar.

6. The tufting machine of claim 5 and wherein each access opening is aligned with at least two of said slots in said module body.

7. The tufting machine of claim 5 and wherein each access opening is aligned with one of said slots in said module body.

8. The tufting machine of claim 5 and wherein said access openings are formed in a beveled edge defined in a corner portion at each of said module bodies between said rear portion of said upper section and said lower section, and extend inwardly and upwardly.

9. The tufting machine of claim 8 and wherein said gauge bar further comprises a beveled edge corresponding to and adapted to engage said beveled edges of said module bodies in mating engagement, and a series of passages formed through said gauge bar and aligned with said access openings of said gauge modules.

10. The tufting machine of claim 5 and wherein said gauge bar further comprises a series of passages formed along a beveled edge defined between a top surface and a rear face of said gauge bar, and which extend inwardly and downwardly toward said slots of said gauge modules.

11. A method of removing and replacing gauge parts releasably mounted in a gauge module attached to a gauge bar in a tufting machine, comprising:

removing at least one fastener from engagement with a gauge part to be removed from the gauge module to release the gauge part from engagement with the gauge module;

with the gauge module remaining attached to the gauge bar, inserting a tool into a passage formed through the gauge bar and aligned with a slot of the gauge module in which the gauge part to be removed is received;

urging at least a portion of the gauge part out of the slot with the tool as the tool is inserted therein;

removing the gauge part; and placing a new gauge part within the slot of the gauge module.

12. The method of claim 11 and further comprising inserting a fastener into the gauge module and into engagement with the new gauge part to secure the gauge part therein.

13. The method of claim 11 and further comprising injecting a cleaning media into the slot through the passage in the gauge bar.

14. The method of claim 13 and wherein injecting a cleaning media comprises applying pressurized air to the passage.

* * * * *